US011114743B2

(12) United States Patent
Hung

(10) Patent No.: US 11,114,743 B2
(45) Date of Patent: Sep. 7, 2021

(54) ELECTRONIC DEVICES WITH ANTENNAS

(71) Applicant: HEWLETT-PACKARD DEVELOPMENT COMPANY, L.P., Spring, TX (US)

(72) Inventor: Kuan-Jung Hung, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 160 days.

(21) Appl. No.: 16/490,652

(22) PCT Filed: Mar. 6, 2017

(86) PCT No.: PCT/US2017/020885
§ 371 (c)(1),
(2) Date: Sep. 3, 2019

(87) PCT Pub. No.: WO2018/164660
PCT Pub. Date: Sep. 13, 2018

(65) Prior Publication Data
US 2020/0014089 A1 Jan. 9, 2020

(51) Int. Cl.
*H01Q 1/22* (2006.01)
*H01Q 5/307* (2015.01)

(52) U.S. Cl.
CPC ..... *H01Q 1/2266* (2013.01); *H01Q 1/2291* (2013.01); *H01Q 5/307* (2015.01)

(58) Field of Classification Search
CPC .... H01Q 1/2266; H01Q 5/307; H01Q 1/2291; H01Q 1/243; H01Q 1/38; H01Q 13/18; H01Q 21/28; H01Q 5/10; H01Q 5/20; H01Q 5/357; H01Q 5/371; H01Q 9/42; G06F 1/1616; G06F 1/1637; G06F 1/1698; H05K 1/0215; H05K 1/0224; H05K 1/028; H05K 9/0054
See application file for complete search history.

(56) References Cited

U.S. PATENT DOCUMENTS

| | | | | |
|---|---|---|---|---|
| 6,853,336 | B2 | 2/2005 | Asano et al. | |
| 7,068,229 | B2 | 6/2006 | Lin | |
| 7,072,690 | B2 | 7/2006 | Shin et al. | |
| 8,059,039 | B2 | 11/2011 | Ayala Vazquez et al. | |
| 8,125,394 | B2 | 2/2012 | Chiang | |
| 9,203,137 | B1 | 12/2015 | Guterman et al. | |
| 9,350,068 | B2 | 5/2016 | Guterman et al. | |
| 2010/0073242 | A1* | 3/2010 | Vazquez | H01Q 21/28 343/702 |
| 2014/0097992 | A1* | 4/2014 | Cheng | H01Q 1/2266 343/702 |
| 2014/0361932 | A1* | 12/2014 | Irci | H01Q 21/28 343/702 |
| 2015/0222007 | A1* | 8/2015 | Leonard | H01Q 1/2266 343/702 |
| 2015/0270598 | A1* | 9/2015 | Guterman | H05K 1/028 343/702 |

OTHER PUBLICATIONS

Cavity-Backed Slot Antennas for Wireless Portable Devices.

(Continued)

*Primary Examiner* — Renan Luque
(74) *Attorney, Agent, or Firm* — HPI Patent Department

(57) ABSTRACT

The present subject matter describes positioning of an antenna in an electronic device. The antenna includes an antenna holder spanning within a length of a slot for a hinge of the electronic device or spanning within a length of the hinge.

12 Claims, 7 Drawing Sheets

(56) References Cited

OTHER PUBLICATIONS

This is How Lenovo Made Connectivity for Convertibles Even Better, Jun. 27, 2016, <http://blog.lenovo.com/en/blog/this-is-how-lenovo-made-connectivity-for-convertibles-even-better/?cid=ww:social:518288940:518288939:TWITTER:lerovo:PRODUCTS&linkId=26624012 >.
Tiny Multi-function Antenna for Laptops, Jun. 24, 2016, <https://www.sciencedaily.com/releases/2016/06/160624110151.html>.

* cited by examiner

ELECTRONIC DEVICES WITH ANTENNAS

BACKGROUND

Electronic devices, such as laptops and cellular telephones, include antennas for wireless communication. Such antennas may be mounted in an enclosure or housing of the electronic device. The antennas mounted in the enclosure have wireless communication capabilities to communicate with wireless networks and satellite navigation systems.

BRIEF DESCRIPTION OF DRAWINGS

The following detailed description references the drawings, herein.

DETAILED DESCRIPTION

Figure 1:
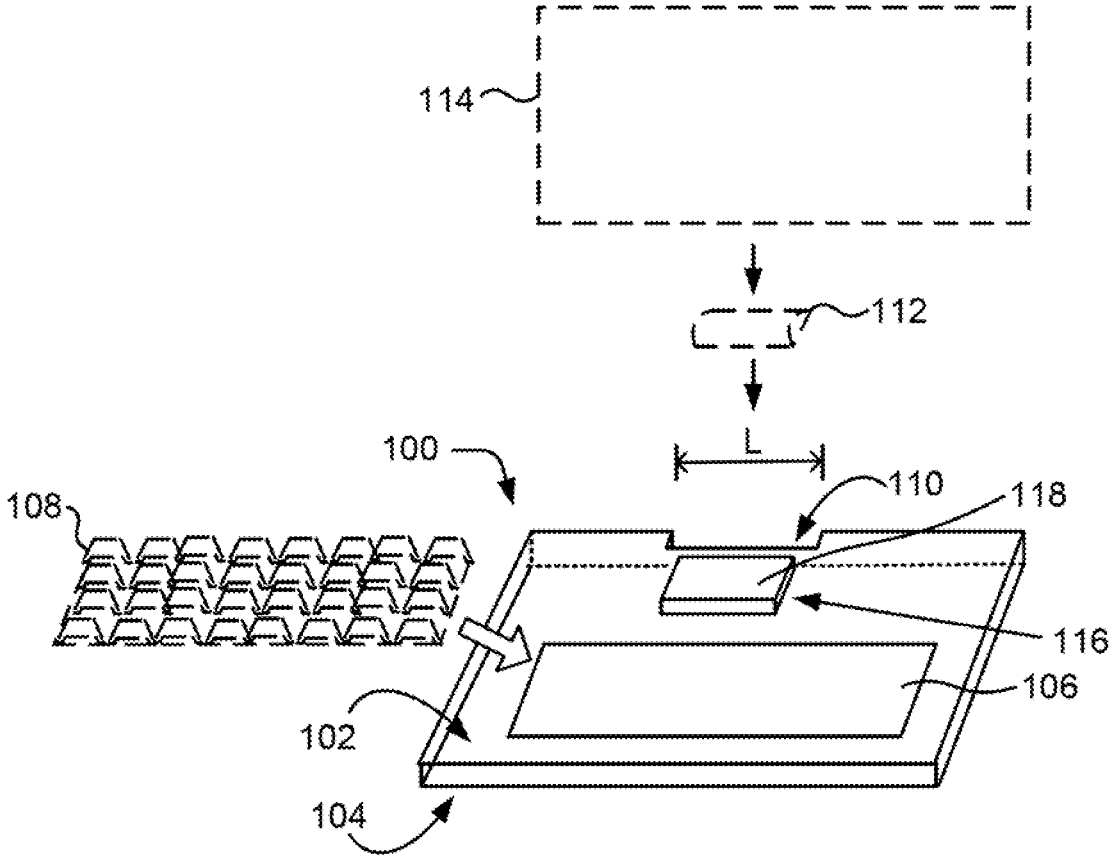
FIG. 1 illustrates a perspective view of an enclosure of an electronic device, according to an example implementation of the present subject matter.

Electronic devices have an enclosure in which electronic components, such as keyboard, processor(s), memory, etc., are housed. The enclosure may be coupled to a display unit through a coupling element, such as a hinge. In an example, the electronic device may be a laptop having a keyboard in the enclosure and a display panel in the display unit. The display unit may be rotated about an axis of rotation of the coupling element to adjust the position of the display unit relative to the enclosure.

The enclosure may be formed of metal, plastic, carbon fiber composites, metal insert molded components, or a combination thereof. Further, in an example, the enclosure may be formed as a single piece in which mounting structures, such as slots are present for mounting of the electronic components. In another example, the enclosure may be formed by attaching together multiple pieces, such as frame/chassis structures, housing walls, etc. to form an integrated structure.

Some portions of the enclosure may be made of metal, Antennas are generally mounted in a slot provided within the metal portion of the enclosure. The slot for the antenna, also called an antenna window, may be generally a cut-out in the metal portion. In assembly, the antenna is placed in the slot and then the slot is covered with a plastic filling member. The slot is covered with the plastic filling member to enable wireless electromagnetic signals from the antenna to be radiated out of the enclosure through walls of the plastic filling member. The plastic filling member is then coated with metal-finish paints in order to give the plastic filling member an appearance similar to the surrounding metal portion of the enclosure. Cutting a slot in the metal portion, positioning the antenna in the slot, covering the slot with the plastic filling member, and coating the plastic filling member with metal-finish paints involves additional material cost of the plastic filling member and the metal-finish paints and also involves additional production steps and production time. Further, in some electronic devices, the antenna may be positioned inside the coupling element, i.e. the hinge. Configuring the antenna to be accommodated within the hinge may be complex.

The present subject matter relates to enclosures of electronic devices with antennas mounted in the enclosures. Such enclosures are manufactured without cutting an antenna window in the enclosure may be avoided. This reduces the number of production steps, production time, and facilitates in eliminating use of additional plastic filling members and metallic paints on the plastic filling members, thereby reducing complexity and costs of manufacturing processes.

According to an example implementation of the present subject matter, an enclosure of an electronic device includes a first slot for a keyboard unit and a second slot for a hinge. In an example implementation, the electronic device may be a laptop or a mobile phone. The enclosure may be a base unit of the electronic device which may house the electronic components, such as processor(s), memory, interface(s), etc. of the electronic device. The enclosure has a top side and a bottom side. The first slot may be formed on the top side of the enclosure. The first slot is formed such that the keyboard may be fitted in the first slot. The second slot may be formed towards an edge of the enclosure so that a hinge or a portion thereof may be fitted in the second slot. The hinge is operable to couple the enclosure with a display unit of the electronic device.

The enclosure includes an antenna positioned on the bottom side of the enclosure. The antenna includes an antenna holder, where the antenna holder spans within a length of the second slot. In an example implementation, the antenna may be a cavity antenna having an excitation surface to transceive wireless antenna signals. The excitation surface of the antenna may face the second slot for the hinge.

Positioning of the antenna on the bottom side of the enclosure with the antenna holder spanning the length of the slot for the hinge enables electromagnetic signals of the antenna to travel through the slot for the hinge. Thus, forming of antenna windows in the enclosure, use of plastic filing members to cover the antenna windows, and use of metal-finish paints on the plastic members are avoided. This reduces the cost and time associated with the manufacturing processes of the enclosures of electronic devices with antennas. Also, with the enclosures and the electronic devices of the present subject matter, as the excitation surface is faced towards the slot for the hinge, i.e., outwards from internal electronic assembly of the electronic device, the internal electronic assembly is exposed to lower amounts of electromagnetic radiation emitted by the antenna. Therefore, chances of faults or damage to the internal electronic assembly due to interference of electromagnetic radiations emanating from the antenna are reduced.

The following detailed description refers to the accompanying drawings. Wherever possible, the same reference numbers are used in the drawings and the following description to refer to the same or similar parts. While several examples are described in the description, modifications, adaptations, and other implementations are possible.

Accordingly, the following detailed description does not limit the disclosed examples. Instead, the proper scope of the disclosed examples may be defined by the appended claims.

FIG. 1 illustrates an enclosure 100 of an electronic device, according to an example implementation of the present subject matter. In an example implementation, the enclosure 100 may be formed as part of a housing or a frame of the electronic device. Various electronic components, such as memory processor, power source(s), interface(s), etc., of the electronic device may be mounted in the enclosure 100. In an example implementation, the enclosure 100 may be formed of metal, plastic, ceramic, glass, or a composite material formed of a combination of these materials.

The enclosure 100 has a first side 102, and a second side 104 opposite to the first side 102. As shown in FIG. 1, the first side 102 is a top side of the enclosure 100 and the second side 104 is a bottom side. The enclosure 100 includes a first slot 106 on the first side 102. The first slot 106 is for a keyboard unit 108 of the electronic device. The first slot 106 is an opening, on the first side 102, which is shaped to receive the keyboard unit 108.

The enclosure 100 includes a second slot 110 for a hinge 112. The second slot 110 may be formed at an edge of the enclosure 100. The hinge 112 is to rotatably couple the enclosure 100 to a display unit 114 of the electronic device. In an example implementation, the hinge 112 may be formed of metal. The display unit 114 may be rotated about an axis of rotation (not shown) of the hinge 112 to adjust the position of the display unit 114 relative to the enclosure 100.

The enclosure 100 includes an antenna 116 positioned on the second side 104, or bottom side, of the enclosure 100. In an example implementation, the antenna 116 may be secured to the second side 104 through mechanical fasteners, such as screws (not shown). In another example implementation, the antenna 116 may be secured to the second side 104 of the enclosure 100 by use of adhesives and may be held within the enclosure 100 by a cover/casing (not shown) of the enclosure 100. The antenna 116 may be, for example, a wireless cavity antenna. In an example implementation, the antenna 116 may be operated to transceive signals in 2.4 Giga Hertz frequency band or 5 Giga Hertz frequency band. In another example implementation, the antenna 116 may be operated as a dual frequency band antenna to transceive signals in, both 2.4 Giga Hertz frequency band and 5 Giga Hertz frequency band. The antenna 116 includes an antenna holder 118. In an example implementation, the antenna holder 118 may be a hollow cuboidal structure made of a di-electric material, such as plastic, glass, ceramic, or a combination thereof. The antenna holder 118 spans within the length 'L' of the second slot 110, as shown in FIG. 1.

Figure 2:
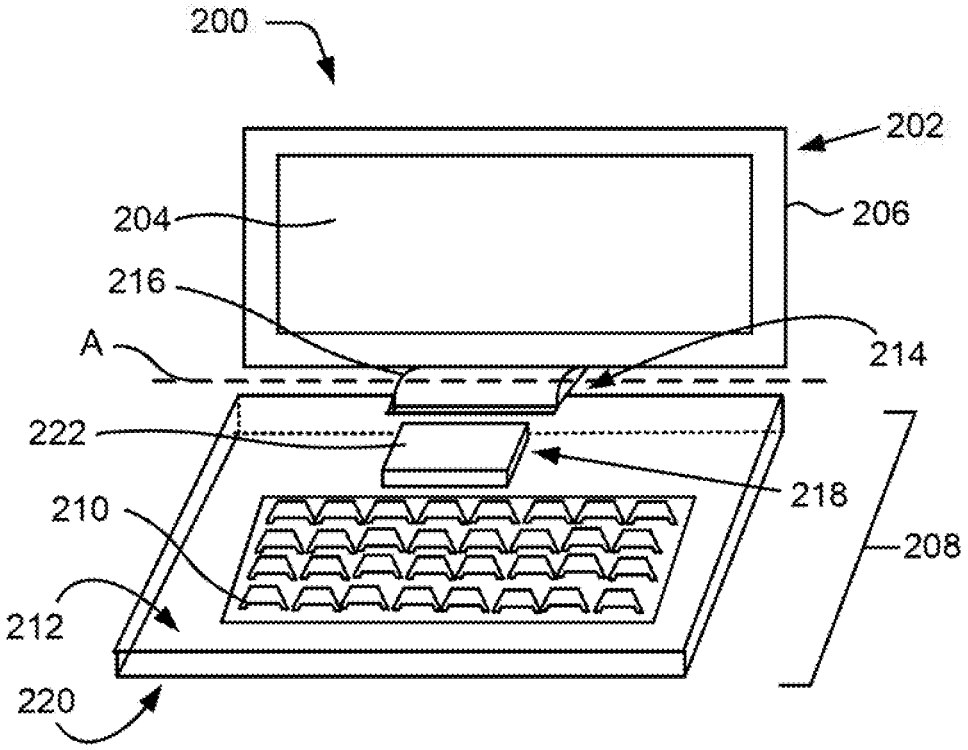
FIG. 2 illustrates a perspective view of an electronic device. according to an example implementation of the present subject matter.

FIG. 2 illustrates a perspective view of an electronic device 200, according to an example implementation of the present subject matter.

The electronic device 200 includes a display unit 202. The display unit 202 includes a display panel 204, The display panel 204 may be, for example, a Liquid crystal display (LCD) panel for rendering visual output of the electronic device 200. In an example implementation, the display panel 204 may include a touchscreen for receiving touch-based inputs from a user. The display unit 202 also includes a frame 206 bordering the display panel 204. In an example implementation, the frame 206 may be formed from metal and may include a slot for mounting of the display panel 204 in the frame 206. The frame 206 may be covered by a plastic casing (not shown).

The electronic device 200 includes a base unit 208. The base unit 208 may be similar to the enclosure 100 of the electronic device, as illustrated in FIG. 1. The base unit 208 houses various electronic components, such as keyboard, antenna, processor, memory, etc., of the electronic device 200.

As shown in FIG. 2, the base unit 208 has a keyboard 210 mounted on a top side 212 of the base unit 208. Further, the base unit 208 includes a slot 214 and a hinge 216 accommodated in the slot 214. The slot 214 is shaped to receive the hinge 216 so that the hinge 216 is held in the slot 214. In an example implementation, a portion of the hinge 216 may reside within the slot 214 and may be secured to the base unit 208 through mechanical fasteners, such as screws (not shown). The hinge 216 couples the base unit 208 with the display unit 202. The display unit 202 is rotatable about an axis of rotation A of the hinge 216 so that the display unit 202 can move relative to the base unit 208. The display unit 202 may be rotated about the axis of rotation A to overlay on the top side 212 of the base unit 208.

The electronic device 200 includes a first antenna 218 positioned on a bottom side 220 of the base unit 208. In an example implementation, a second antenna may be positioned in the frame 206 of the display unit 202, as elaborated later in conjunction with FIG. 6. In an example implementation, the first antenna 218 may be a cavity antenna with resonating elements formed as loop antenna structures, patch antenna structures, inverted-F antenna structures, slot antenna structures, or a combination thereof. The first antenna 218 may be coupled to a power source (not shown) and a transceiver circuitry (not shown) which controls the operation of the first antenna 218 in different communications frequency bands. In an example implementation, the first antenna 218 may be operated to transceive signals in low frequency bands, such as at 2.4 Giga Hertz frequency band, of Wireless Local Area Network (WLAN) communications. In another example implementation, the first antenna 218 may be operated as a dual frequency band antenna to transceive signals in low frequency bands, such as at 2.4 Giga Hertz frequency band, and high frequency bands, such as at 5 Giga Hertz frequency band, of Wireless Local. Area Network (ALAN) communications. The first antenna 218 may be coupled to a control circuitry (not shown) which may include a tuning capacitor or inductor for operating the first antenna 218 at specific frequency bands, such as the high frequency band and the low frequency band. The first antenna 218 includes an antenna holder 222 which houses resonating elements (not shown) of the first antenna 218. The antenna holder 222 spans within a length of the slot 214. Detailed configurations of the antenna holder are described in conjunction with FIG. 3.

Figure 3:
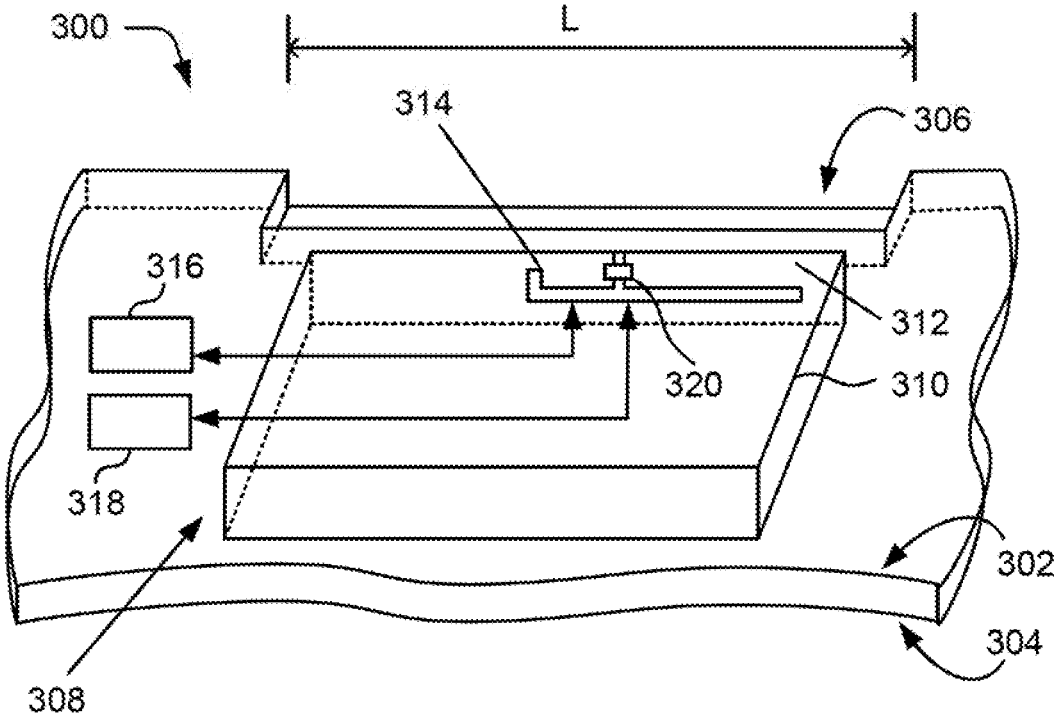
FIG. 3 illustrates a magnified perspective view of a portion of an enclosure of an electronic device, according to an example implementation of the present subject matter.

FIG. 3 illustrates a magnified perspective view of a portion 300 of an enclosure of an electronic device having an antenna and a slot for a hinge, according to an example implementation of the present subject matter. The portion 300 of the enclosure, as shown in FIG. 3, may be a portion of the enclosure 100 having an antenna 116 and a slot 110, as illustrated in FIG. 1 or a portion of the base unit 208 having an antenna 218 and a slot 214, as illustrated in FIG. 2. The portion 300 of the enclosure is also referred to as an enclosure portion 300.

The enclosure portion 300 has a top side 302 and a bottom side 304. The enclosure portion 300 has a slot 306 for a hinge (not shown in FIG. 3), The slot 306 may be similar to the second slot 110 as illustrated in FIG. 1 or the slot 214 as illustrated in FIG. 2. The hinge (not, shown) may be accommodated in the slot 306. The hinge (not shown) facilitates movement of a display unit (not shown) relative to the enclosure. In an example implementation, the slot 308 may have a length 'L' ranging from about 35 mm to about 45 mm.

An antenna 308 may be positioned within the enclosure portion 300, on the bottom side 304 of the enclosure portion 300. The antenna 308 may be similar to the antenna 116 as illustrated in FIG. 1 or antenna 218 as illustrated in FIG. 2. The antenna 308 includes an antenna holder 310. In an example implementation, the antenna holder 310 may be secured to the bottom side 304 of the enclosure portion 300 and may be housed within the enclosure. The antenna holder 310 may be secured to the bottom side 304 by use of adhesives. The antenna holder 310 is substantially parallel to the slot 306 for the hinge (not shown) and has a length equal to or less than the length 'L' of the slot 306.

The antenna holder 310 has a hollow cuboidal structure, as shown in FIG. 3. In an example implementation, the antenna holder has a length of about 35 mm, a breadth of about 8 mm, and a height of about 6 mm. The antenna holder 310 has an excitation surface 312 formed on one side of the cuboidal structure. The other five sides of the antenna holder 310 may form ground surfaces (not depicted in FIG. 3) of the antenna 308. The excitation surface 312 faces the slot 306, as show in FIG. 3, and enables transceiving electromagnetic signals of the antenna 308. The antenna holder 310 may be formed of a di-electric material, such as plastic, glass, ceramic or a combination thereof. In an example implementation, the hollow portion within the antenna holder 310 may also be partly filled with the di-electric material, such as ceramic.

Figure 4:
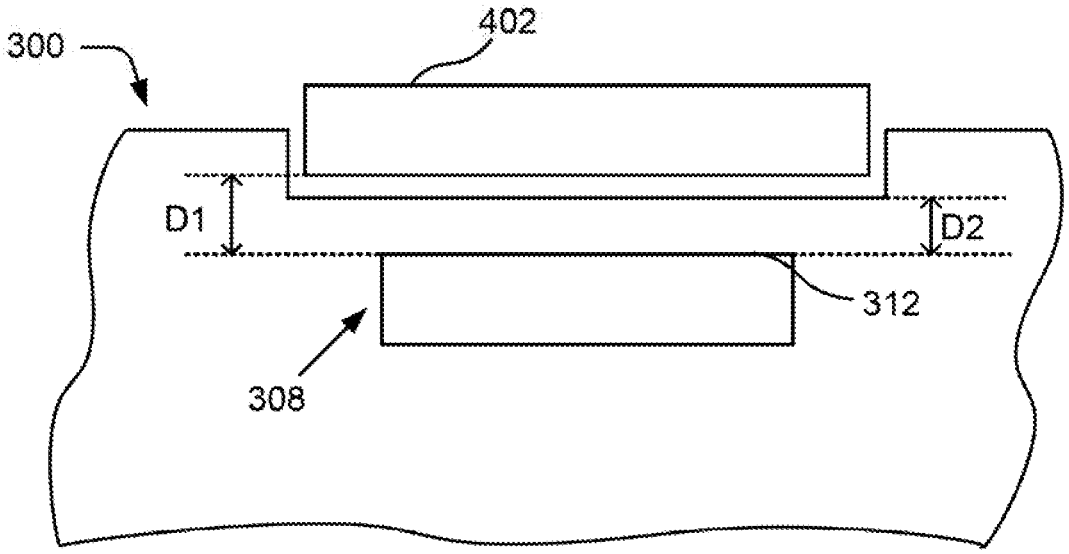
FIG. 4 illustrates a magnified top view of the portion of the enclosure illustrated in FIG. 3, according to an example implementation of the present subject matter.

The position of the excitation surface 312 with respect to the slot 306 is further illustrated through FIG. 4. FIG. 4 illustrates a top view of the enclosure portion 300 of FIG. 3, with a hinge 402 placed in the slot 306. The excitation surface 312, as depicted in FIG. 4, is at a first distance D1 from the hinge 402 and at a second distance D2 from an edge of the enclosure or the base unit, where the second distance D2 is less that the first distance D1. In an example implementation, the first distance D1 is about 2.5 mm and the second distance D2 is about 1 mm. The distance D1 and D2 may be parameters for antenna impedance and electromagnetic radiation pattern tuning.

As shown in FIG. 3, metal traces 314 are formed on the excitation surface 312. The metal traces 314 may be formed on the excitation surface 312 through laser patterning techniques by which portions of a di-electric material, such as plastic, may be selectively coated with a metal. In an example implementation, other techniques of forming antenna, such as fastening patterned metallic foils, mounting flexible printed circuits, etc., can be used to form the metal traces 314 on the excitation surface 312. The metal traces 314 function as resonating elements of the antenna 308 and facilitate in transceiving wireless electromagnetic signals. The metal traces 314 may include feed terminals (not shown) which may be connected to a power source 316. In an example implementation, the metal traces 314 may be connected to the power source 316 through coaxial cables. The metal traces 314 may also be coupled to a control unit 318. The control unit 318 may include a transceiver circuitry which may control operations of the antenna 308 in, for example, 2.4 Giga Hertz and 5 Giga Hertz frequency bands. The metal traces 314 may be coupled to the control unit 318 through coaxial cables, micro-strip transmission lines, or the like. The metal traces 314 also include a circuit component 320. In an example implementation, the circuit component 320 may be a tunable capacitor, an L/C matching component, a radio-frequency (RF) switch, a RF filter, etc., for operation of the antenna 308 over varying frequency bands.

The ground surfaces (not depicted in FIG. 3) of the antenna holder 310 are formed by coating a metal layer on the di-electric material of the antenna holder 310. In an example implementation, the metal layer may be coated by painting a metal paint on the di-electric material or through electroplating using metal foils. In an example, implementation, the ground, surfaces may be partly ground surfaces or wholly ground surfaces. The wholly ground surfaces may be formed by covering the surfaces completely by the metal layer. The partly ground surfaces may be formed by covering a portion of a surface by the metal layer and by forming metal radiator traces on the remaining portion of the surface which radiate electromagnetic signals. The ground surfaces of the antenna holder 310 may be connected to an electrical ground of an electronic device, such as the electronic device 200.

The conductive metal layer on the ground surfaces shields electromagnetic fields of the antenna 308 from escaping or entering through the ground surfaces and thereby facilitates operation of the antenna 308. With the excitation surface 312 facing the slot 306 and the ground surfaces being positioned towards the internal electronic components, such as a keyboard unit, a processor, a memory etc., of the electronic device, the electromagnetic fields to and from the antenna 308 travel through the slot 306 and outwards away from the internal electronic components. Thus, there are less chances of interference of the electromagnetic fields of the antenna with the internal electronic components.

Figure 5:
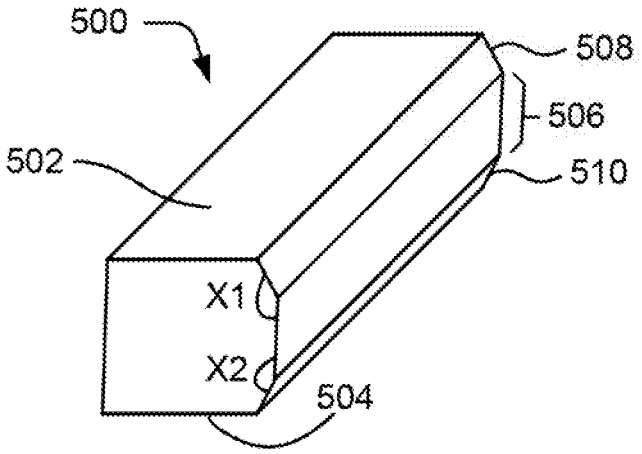
FIG. 5 illustrates an antenna holder, according to n example implementation of the present subject matter.

FIG. 5 illustrates an antenna holder 500, according to an example implementation of the present subject matter. The antenna holder 500 has a first ground surface 502, along a length of the antenna holder 500, and a second ground surface 504 opposite to the first ground surface 502. The first ground surface 502 and the second ground surface 504 may have similar properties and characteristics as the ground surfaces of the antenna holder 310 of FIG. 3. The antenna holder 500 also has an excitation surface 506. The excitation surface 506 may have similar properties and characteristics as the excitation surface 312 of FIG. 3. The first ground surface 502 and the second ground surface 504 may be connected by a metal film (not shown) running along a surface opposite to the excitation surface 506.

As shown in FIG. 5, the first ground surface 502 has a first beveled edge 508. The first ground surface 502 meets the excitation surface 506 at the first beveled edge 508. The first beveled edge 508 has an angle of slope, denoted as X1, with respect to the excitation surface 506. In an example implementation, X1 may range from about 110 degrees to about 170 degrees.

The second ground surface 504 has a second beveled edge 510. The second ground surface 504 meets the excitation surface 506 at the second beveled edge 510. The second beveled edge 510 has an angle of slope, denoted as X2, with respect to the excitation surface 506. In an example implementation, X2 may range from about 110 degrees to about 170.

Thus, with the configuration as illustrated through FIG. 5, the surface area of the excitation surface 506 is reduced. This may further facilitate in reducing the SAR of electromagnetic signals emitted by the excitation surface 506.

Figure 6:
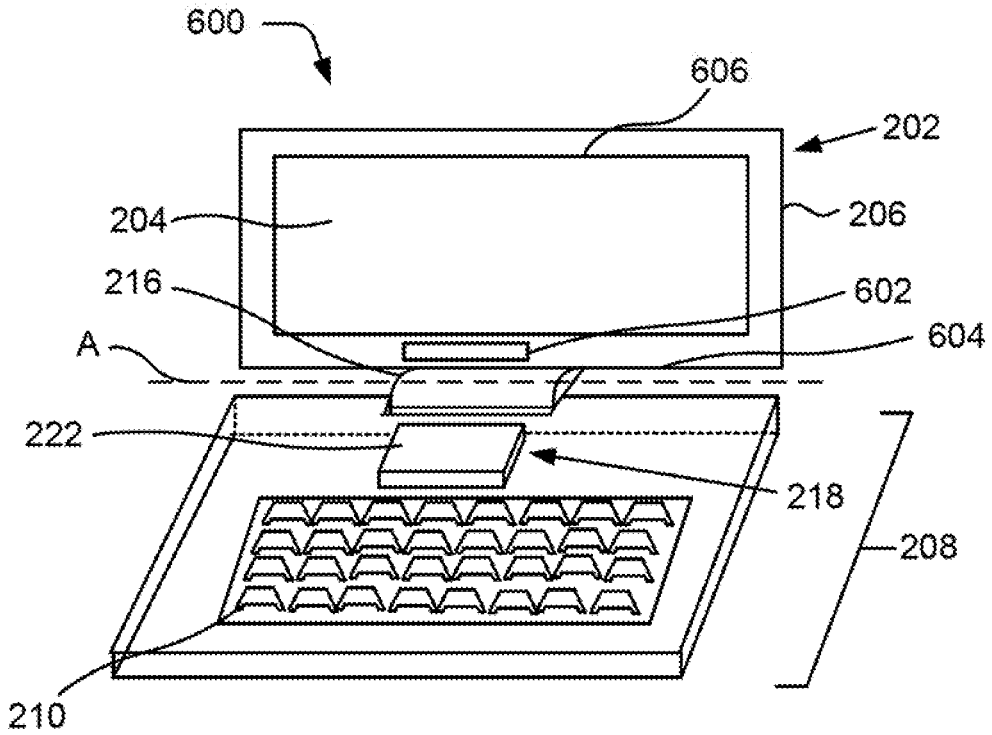
FIG. 6 illustrates a perspective view of an electronic device, according to an example implementation of the present subject matter.

FIG. 6 illustrates a perspective view of an electronic device 600, according to an example implementation of the present subject matter. The electronic device 600 illustrated in FIG. 6 is similar to the electronic device 200 of FIG. 2. Wherever possible, same reference numbers as used in FIG.

2 are used to refer to the same or similar parts of the electronic device 600 of FIG. 6. As shown in FIG. 6, a second antenna 602 is positioned along an edge 604 of the frame 206 of the display unit 202. The edge 604 is substantially parallel to the axis of rotation A of the hinge 218. In an example implementation, the second antenna 602 may be a slot antenna, a loop antenna, a planar inverted-F (PIFA) antenna, a cavity antenna, or the like. The second antenna 602 may be fastened to the frame 206 along the edge 604 by use of adhesives or mechanical fasteners, such as screws (not shown).

In the electronic device 600, the first antenna 218 is operated to transceive signals in a low frequency band, such as 2.4 Giga Hertz frequency band, of WLAN communications and the second antenna 602 may be operated to transceive signals in high frequency bands, such as at 5 Giga Hertz frequency band, of WLAN communications. The first and second antennas may be coupled to a tuning circuitry, such as an inductor-capacitor tuning circuitry, within the electronic device 600 which may tune the first antenna 218 to operate in the low frequency band and may tune the second antenna 602 to operate in the high frequency band. Although, FIG. 6 shows the second antenna 602 positioned along the edge 604 closer to the hinge 216; in an example implementation, the second antenna may be positioned along an edge 606 of the frame 206 which is opposite to the edge 604. Further, although a single antenna positioned on the frame 206 of the display unit 202 is shown in FIG. 6, in an example implementation, multiple antennas may be positioned along any one of the edges 604 and 606 of the frame 206.

Positioning the first antenna 218, tuned to operate in the 2.4 Gigs Hertz frequency band, in the base unit 208 and the second antenna 602, tuned to operate in the 5 Giga Hertz frequency band, in the display unit 202, facilitate in reducing the SAR of electromagnetic signals radiating from the electronic device 600.

Figure 7:
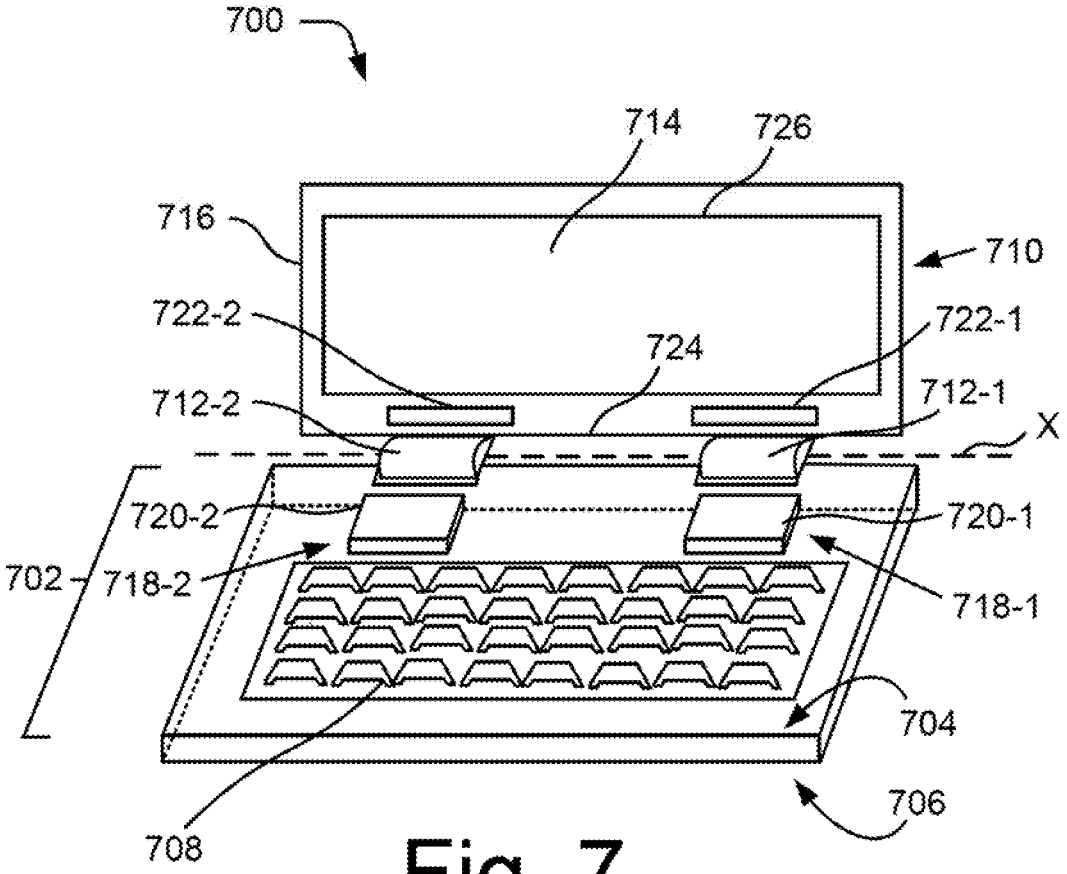
FIG. 7 illustrates a perspective view of an electronic device having a plurality of antennas, according to an example implementation of the present subject matter.

FIG. 7 illustrates an electronic device 700 having a plurality of antennas, according to an example implementation of the present subject matter. The electronic device may be a laptop computer, a laptop-tablet convertible, a cellular telephone, or the like.

The electronic device 700 has a base unit 702. The base unit 702 has a top side 704 and a bottom side 706. The electronic device 700 includes a keyboard 708 mounted on the top side 704 of the base unit 702.

The electronic device 700 has a display unit 710 for rendering visual output of the electronic device 700. In an example implementation, the display unit 710 may be coupled to the base unit 702 through a plurality of hinges. As shown in FIG. 7, the display unit 710 is coupled to the base unit 702 through a first hinge 712-1 and a second hinge 712-2. The first hinge 712-1 and the second hinge 712-2 may be aligned so that the first and second hinges 712-1 and 712-2 have a common axis of rotation X. The position of the display unit 710 relative to the base unit 702 may be adjusted by rotating the display unit 710 about the axis of rotation X. The display unit 710 also includes a display panel 714 and a frame 716. The frame 716 borders the display panel 714.

As shown in FIG. 7, the electronic device 700 includes a first set of antennas 718-1 and 718-2, positioned on the bottom side 706 of the base unit 702. The antenna 718-1 includes an antenna holder 720-1 and the antenna 718-2 includes an antenna holder 720-2. In an example implementation, the antenna holders 720-1 and 720-2 may be similar to the antenna holder 310 of FIG. 3 or the antenna holder 500 of FIG. 5, The antenna holder 720-1 is parallel to the first hinge 712-1 and spans within a length of the first hinge 712-1. The antenna holder 720-1 may have a length equal to or less than a length of the first hinge 712-1. The antenna holder 720-2 is parallel to the second hinge 712-2 and spans within a length of the second hinge 712-2. The antenna holder 720-2 may have a length equal to or less than the length of the second hinge 712-2. In an example implementation, the first hinge 712-1 and the second hinge 712-2 may have a length of about 45 mm. In an example implementation, the antenna holders 720-1 and 720-2 may have a length of about 35 mm.

Each of the antenna holders 720-1 and 720-2 may include an excitation surface (not shown) to transceive electromagnetic signals. The excitation surface (not shown) of the antenna holder 720-1 faces the first hinge 712-1 and the excitation (not shown) of the antenna holder 720-2 faces the second hinge 712-2. In an example implementation, the excitation surfaces of the antenna holders 720-1 and 720-2 may have a configuration similar to the excitation surface 313 of FIG. 3 or the excitation surface 506 of FIG. 5, Further, each of the antenna holders 720-1 and 720-2 may include ground surfaces with beveled edges, as illustrated through FIG. 5, where the ground surfaces meet the respective excitation surfaces at the beveled edges. The first set of antennas 718-1 and 713-2 is tuned such that the respective excitation surfaces can transceive signals in 2.4 Giga Hertz frequency band.

The electronic device 700 also includes a second set of antennas 722-1 and 722-2 positioned along an edge 724 of the frame 716 of the display unit 710. The edge 724 is substantially parallel to the axis of rotation X of the hinges 712-1 and 712-2. The second set of antennas 722-1 and 722-2 is tuned to operate for transceiving signals in 5 Giga Hertz frequency band. Although FIG. 7 shows the second set of antennas 722-1 and 722-2 positioned along the edge 724 which is closer to the hinges; in an example implementation, the second set of antennas may be positioned along an edge 726 of the frame 716, which is opposite to the edge 724.

Although implementations for enclosures of electronic devices and, electronic devices having such enclosures are described in language specific to methods and/or structural features, it is to be understood that the present subject matter is not limited to the specific methods or features described. Rather, the methods and specific features are disclosed and explained as example implementations for enclosures of electronic devices and electronic devices having such enclosures.

I claim:

1. An enclosure of an electronic device, comprising:

a first side and a second side, wherein the first side and the second side are opposite to each other;

a first slot on the first side of the enclosure, wherein the first slot is to receive a keyboard unit;

a second slot for a hinge, wherein the hinge is to couple the enclosure to a display unit; and an antenna positioned on the second side of the enclosure, the antenna comprising an antenna holder, the antenna holder spanning within a length of the second slot and having an excitation surface facing the second slot, the excitation surface to transceive signals, and a first ground surface along a length of the antenna holder, the first ground surface having a first beveled edge, wherein the first ground surface meets the excitation surface at the first beveled edge.

2. The enclosure as claimed in claim 1, wherein the antenna holder is parallel to the second slot and has a length equal to or less than the length of the second slot.

3. The enclosure as claimed in claim 1, wherein the antenna holder has a second ground surface opposite to the first ground surface, the second ground surface having a second beveled edge, wherein the second ground surface meets the excitation surface at the second beveled edge.

4. The enclosure as claimed in claim 1, wherein the antenna holder has a cuboidal structure and the excitation surface is formed on one side of the cuboidal structure.

5. The enclosure as claimed in claim 1, wherein the antenna is to transceive signals in at least one of 2.4 Giga Hertz frequency band and 5 Giga Hertz frequency band.

6. An electronic device comprising:

a base unit having a keyboard mounted on a top side of the base unit, the base unit comprising:

a slot;

a hinge accommodated in the slot, to couple the base unit to a display unit; and a first antenna positioned on a bottom side of the base unit, the first antenna comprising an antenna holder, the antenna holder spanning within a length of the slot, wherein the antenna holder comprises:

an excitation surface facing the slot, the excitation surface to transceive signals;

a first ground surface along a length of the antenna holder, the first ground surface having a first beveled edge; and a second ground surface opposite to the first ground surface and having a second beveled edge, wherein the excitation surface meets the first and the second beveled edges.

7. The electronic device as claimed in claim 6, wherein the first antenna is to transceive signals in 2.4 Giga Hertz frequency band.

8. The electronic device as claimed in claim 6, further comprising a second antenna positioned along an edge of a frame of the display unit, the edge being parallel to an axis of rotation of the hinge, wherein the second antenna is to transceive signals in 5 Giga Hertz frequency band.

9. The electronic device as claimed in claim 6, wherein the antenna holder is parallel to the slot and has a length equal to or less than the length of the slot.

10. The electronic device as claimed in claim 6, wherein the excitation surface is at a first distance from the hinge and at a second distance from an edge of the base unit, the second distance being less than the first distance.

11. An electronic device comprising:

a base unit including a keyboard mounted on a top side of the base unit;

a display unit coupled to the base unit though a plurality of hinges, the display unit comprising a display panel and a frame, the frame bordering the display panel; and a first set of antennas positioned on a bottom side of the base unit, each of the first set of antennas comprising an antenna holder, the antenna holder being parallel to a hinge from the plurality of hinges and spanning within a length of the hinge, the antenna holder including:

an excitation surface to transceive signals in 2.4 Giga Hertz frequency band, wherein the excitation surface faces the hinge, and a ground surface along a length of the antenna holder and having a beveled edge, wherein the ground surface meets the excitation surface at the beveled edge; and a second set of antennas positioned along an edge of the frame of the display unit, the edge being parallel to an axis of rotation of the hinge, wherein the second set of antennas is to transceive signals in 5 Giga Hertz frequency band.

12. The electronic device as claimed in claim 11, wherein the ground surface is a first ground surface and the beveled edge is a first beveled edge, and wherein the antenna holder comprises:

a second ground surface opposite to the first ground surface, the second ground surface having a second beveled edge, wherein the second ground surface meets the excitation surface at the second beveled edge.

* * * * *